US008828214B2

(12) United States Patent
Smallwood et al.

(10) Patent No.: US 8,828,214 B2
(45) Date of Patent: Sep. 9, 2014

(54) SYSTEM, METHOD, AND APPARATUS FOR LEACHING CAST COMPONENTS

(75) Inventors: Michel Shawn Smallwood, Greenwood, IN (US); Tab Michael Heffernan, Plainfield, IN (US); Mark Steven McCormick, Martinsville, IN (US); Randolph Clifford Helmink, Avon, IN (US); Matthew Kush, Martinsville, IN (US)

(73) Assignees: Rolls-Royce Corporation, Indianapolis, IN (US); Rolls-Royce North American Technologies, Inc., Indianapolis, IN (US)

( * ) Notice: Subject to any disclaimer, the term of this patent is extended or adjusted under 35 U.S.C. 154(b) by 85 days.

(21) Appl. No.: 13/338,811

(22) Filed: Dec. 28, 2011

(65) Prior Publication Data

US 2012/0222961 A1 Sep. 6, 2012

Related U.S. Application Data

(60) Provisional application No. 61/428,720, filed on Dec. 30, 2010.

(51) Int. Cl.

| | |
|---|---|
| ***C23C 28/02*** | (2006.01) |
| ***C25D 3/56*** | (2006.01) |
| ***C25D 3/50*** | (2006.01) |
| ***B22D 29/00*** | (2006.01) |
| ***C23G 1/00*** | (2006.01) |

(52) U.S. Cl.

CPC ..... *B22D 29/002* (2013.01); *B22D 29/006* (2013.01); *C23G 1/00* (2013.01)

USPC ..... 205/187; 205/255; 205/265

(58) Field of Classification Search

USPC ..... 205/187, 265

See application file for complete search history.

(56) References Cited

U.S. PATENT DOCUMENTS 3,528,861 A * 9/1970 Elam et al. ..... 148/534
4,055,706 A * 10/1977 Galmiche et al. ..... 428/652

(Continued)

FOREIGN PATENT DOCUMENTS

EP 0 922 514 A2 6/1999
EP 1 358 958 A1 11/2003

(Continued)

OTHER PUBLICATIONS

EP Examination Report dated Feb. 13, 2013 in counterpart EP Patent Application No. 11250949.2 (5 pages).

(Continued)

*Primary Examiner* — Nicholas A Smith
*Assistant Examiner* — Brian W Cohen
(74) *Attorney, Agent, or Firm* — Krieg DeVault LLP

(57) ABSTRACT

A method includes removing a casting shell and core from a cast component, which may be a gas turbine blade. The method further includes utilizing a focused removal technique, such as a water jet or laser drill, to remove a portion of a virtual pattern cast (VPC) shell from the cast component. The cast component is then exposed to a leaching solution and high pressure water wash to remove an internal core material and a portion of the VPC shell remainder from the cast component. The method further includes exposing the cast component to a high agitation leaching solution and to the high pressure water wash for a minimal time. An electroless nickel-boron coating is then applied to the cast component, and an electrolytic palladium coating is further applied to the cast component. The cast component is further exposed to a high agitation leaching solution for an extended period.

18 Claims, 6 Drawing Sheets

(56) References Cited

U.S. PATENT DOCUMENTS

| | | | |
|---|---|---|---|
| 4,073,662 | A | 2/1978 | Borom |
| 4,141,781 | A | 2/1979 | Greskovich et al. |
| 4,317,685 | A | 3/1982 | Ahuja et al. |
| 4,439,241 | A | 3/1984 | Ault et al. |
| 4,552,198 | A | 11/1985 | Mills et al. |
| 5,332,023 | A | 7/1994 | Mills |
| 5,678,583 | A | 10/1997 | Conroy et al. |
| 5,778,963 | A | 7/1998 | Parille et al. |
| 5,779,809 | A | 7/1998 | Sangeeta |
| 6,099,655 | A | 8/2000 | Farr et al. |
| 6,241,000 | B1 | 6/2001 | Conroy et al. |
| 6,474,348 | B1 | 11/2002 | Beggs et al. |
| 6,475,289 | B2 | 11/2002 | Schilbe et al. |
| 6,739,380 | B2 | 5/2004 | Schlienger et al. |
| 6,878,215 | B1 | 4/2005 | Zimmerman, Jr. |
| 6,945,262 | B2 | 9/2005 | Farr et al. |
| 6,974,636 | B2 * | 12/2005 | Darolia et al. ..... 428/632 |
| 7,341,427 | B2 * | 3/2008 | Farmer et al. ..... 415/191 |
| 7,771,578 | B2 * | 8/2010 | Albrecht et al. ..... 205/96 |
| 2002/0074017 | A1 | 6/2002 | Schilbe et al. |
| 2002/0100492 | A1 | 8/2002 | Risbeck et al. |
| 2004/0003909 | A1 | 1/2004 | Schlienger et al. |

FOREIGN PATENT DOCUMENTS

| | | | |
|---|---|---|---|
| GB | 2 266 677 | A | 11/1993 |
| WO | WO 2011/017641 | A1 | 2/2011 |
| WO | WO 2011/019667 | A1 | 2/2011 |

OTHER PUBLICATIONS

Extended Search Report by European Patent Office to Rolls-Royce Corporation, et al., May 16, 2012.

* cited by examiner

SYSTEM, METHOD, AND APPARATUS FOR LEACHING CAST COMPONENTS

RELATED APPLICATIONS

The present application claims the benefit of U.S. Provisional Patent Application No. 61/428,720 filed Dec. 30, 2010 which is incorporated herein by reference.

BACKGROUND

One significant complication in modern casting processes is the removal of the casting shell and core from the cast component. Some modern casting processes utilize complex core designs for intricate castings plus core materials that are not easily destroyed relative to the cast component. For example, gas turbine engine blades often have cooling passages with very complex features, and may be superalloy products with a ceramic core. Some applications have stringent material property requirements, and are therefore not robust to any significant degradation of the cast component material during removal of the core and shell. However, commercial component manufacturing requires that core and shell materials be removed as quickly and inexpensively as possible. The present invention contemplates unique solutions to these and other problems.

SUMMARY

A method includes removing a casting shell and core from a cast component, which may be a gas turbine blade. The method further includes utilizing a focused removal technique, such as a water jet or laser drill, to remove a portion of a virtual pattern cast (VPC) shell from the cast component. The cast component is then exposed to a leaching solution and high pressure water wash to remove an internal core material and a portion of the VPC shell remainder from the cast component. The method further includes exposing the cast component to a high agitation leaching solution and to the high pressure water wash for a minimal time. An electroless nickel-boron coating is then applied to the cast component, and an electrolytic palladium coating is further applied to the cast component. The cast component is further exposed to a high agitation leaching solution for an extended period.

DETAILED DESCRIPTION

Figure 1:
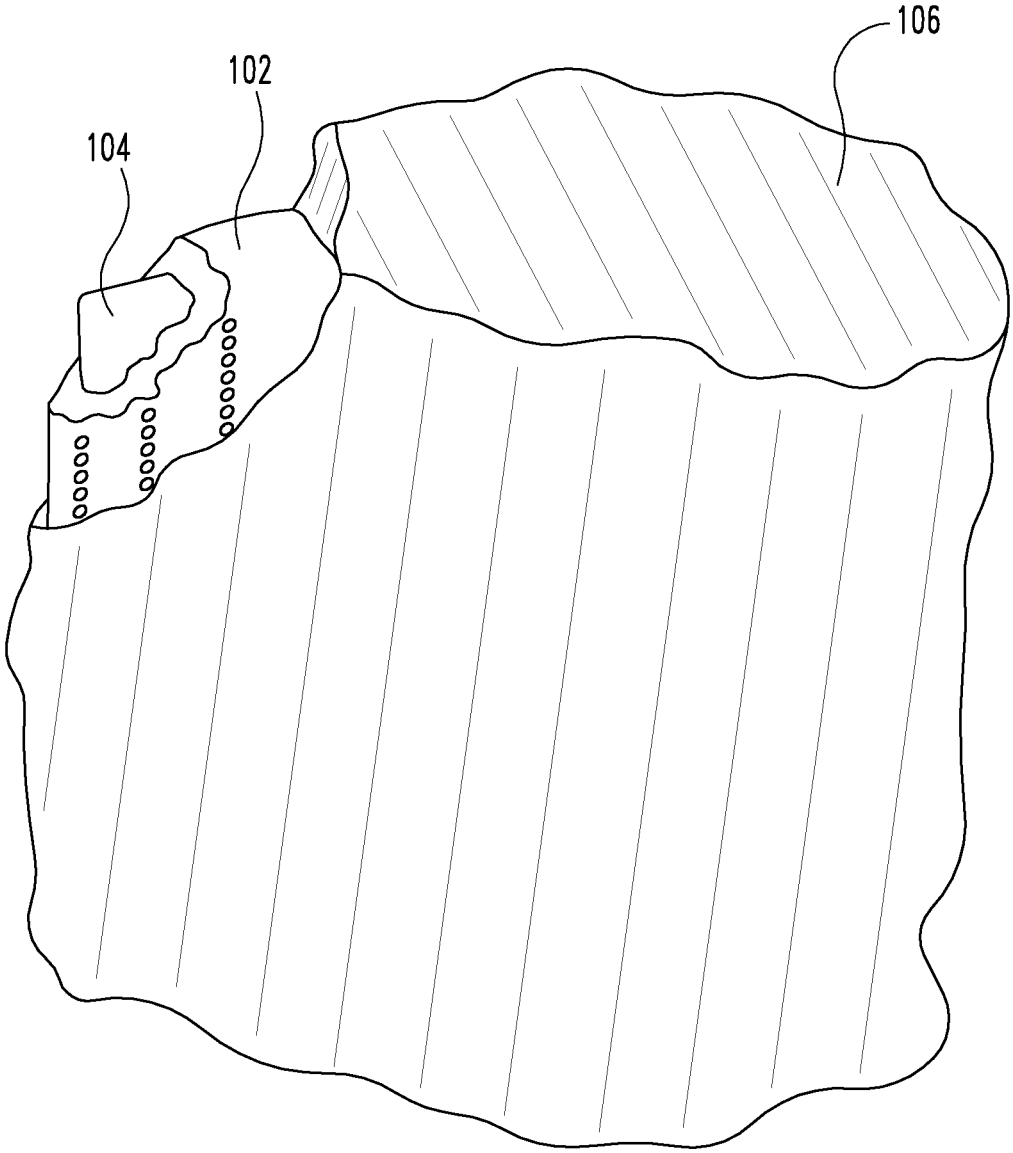
FIG. 1 is an illustrative cross-sectional view of a cast component with a ceramic core and ceramic shell.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated embodiments, and that such further applications of the principles of the invention as illustrated therein as would normally occur to one skilled in the art to which the invention relates are contemplated and protected.

FIG. 1 is an illustrative cross-sectional view of a cast component 102 with a ceramic core 104 and ceramic shell 106. The cast component 102 further includes a plurality of discharge holes 108 for a cooling system (not shown) within the cast component 102. The cast component 102 is representative of a blade for a gas turbine engine. However, it is understood that any cast component 102 having a shell 106 and core 104 that require removal is contemplated for the present application.

A number of casting methods are known to those in the art, and any casting method producing a cast component 102 with a shell 106 and a core 104 is contemplated for the present application. No further details of a casting process are included to avoid obscuring aspects of the present application. The cast component 102 may be a metal, and may further be a superalloy. The core 104 and shell 106 may be ceramic or any other material known in the art, and may be of any shape or configuration.

Figure 2:
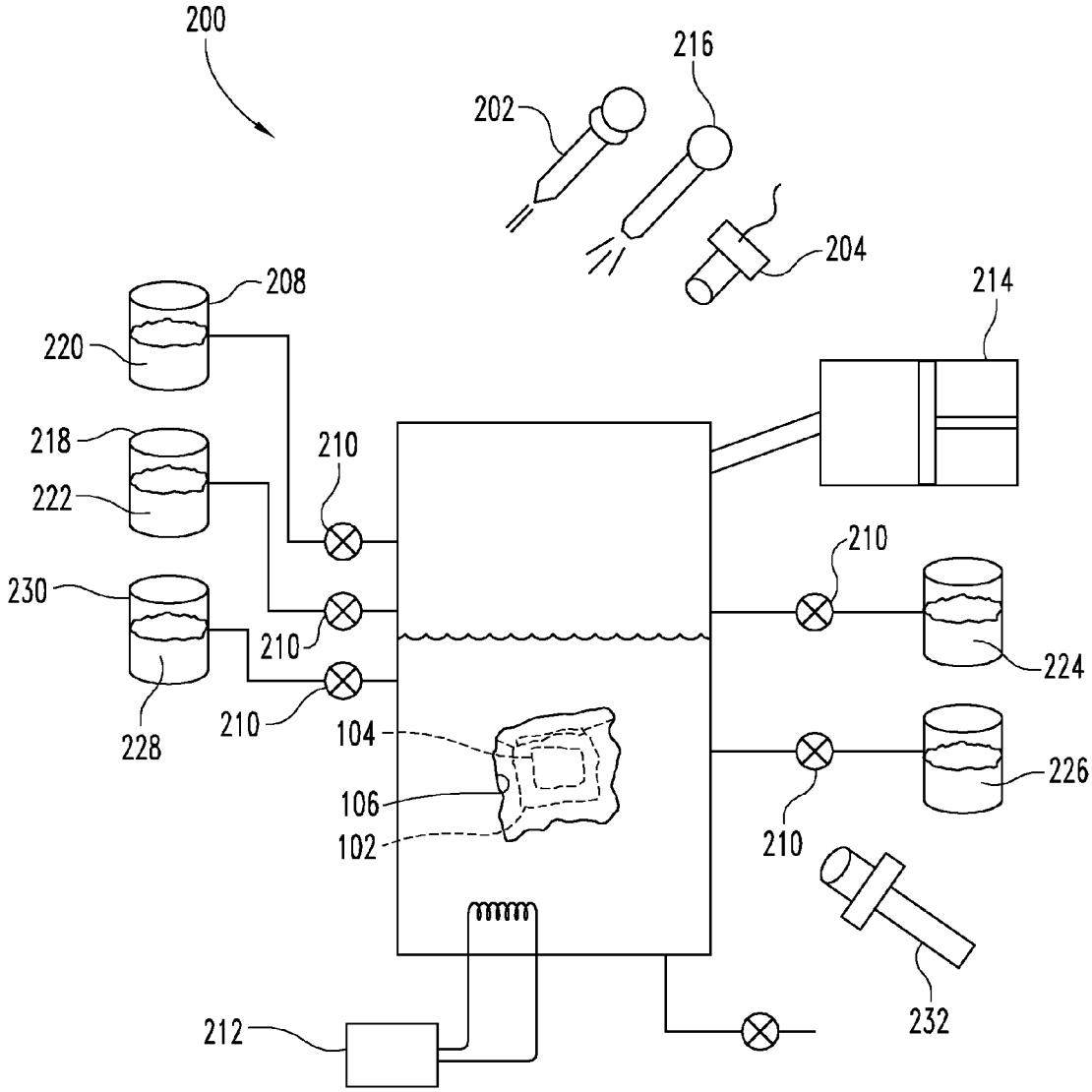
FIG. 2 schematically illustrates a system for leaching castings.

FIG. 2 schematically illustrates a system 200 for leaching cast components 102. The system 200 includes a water jet 202 and/or a laser drill 204 adapted to remove at least a portion of a virtual pattern cast (VPC) shell 106 from a cast component 102. The water jet 202 and/or laser drill 204 may be utilized to increase surface area exposure of the shell 106 and/or core 104 to a subsequent chemical treatment. For example, the shell 106 and core 104 may be ceramic, and the subsequent chemical treatment may include a caustic bath. The water jet 202 and/or laser drill 204 may break off bulk shell 106 pieces and penetrate the shell 106 and core 104 to increase exposure of the ceramic to the caustic bath.

The system 200 further includes a submersion vessel 206 adapted to contain the cast component 102 and a quantity of a leaching solution 220, for example supplied by a caustic tank 208 and valve 210. The submersion vessel 206 is shown as a single batch vessel, but it is understood that the submersion vessel 206 may be a plurality of vessels, a continuous vessel such as a longer vessel with a conveyor, or any other type of vessel known in the art and adaptable to the present application as described herein. The leaching solution 220 may comprise any leaching solution understood in the art to remove casting shell 106 and core 104 material from a cast component 102. The leaching solution 220 may include one or more aqueous alkali hydroxides, alkaline solutions, acidic solutions, and/or solvents. In one embodiment, the cast component 102 is a superalloy, the core 104 and shell 106 material is a ceramic and/or intermetallic, and the leaching solution 220 comprises sodium hydroxide (NaOH), potassium hydroxide (KOH), and/or organic caustic solutions that further include ethanol or similar alcohols. In one embodiment, the leaching solution 220 comprises a low concentration KOH, for example a KOH solution with a concentration below about 65% by weight KOH.

The concentration that is a low concentration of KOH depends upon the specific application, but the low concentration is a concentration that is substantially lower than a saturated KOH solution. Exemplary low concentration values include a solution having a 20% lower KOH concentration than a subsequent high concentration KOH solution (e.g. reference the high agitation leaching solution 222), a solution having a substantially lower KOH concentration than a subsequent high concentration KOH solution, and/or a solution that provides enough activity with the shell 106 and core 104 material that a specified amount (e.g. 80%) of the bulk shell 106 and core 104 material is removed under the agitation conditions presented for a given embodiment. The solution strength that is a low concentration and that provides sufficient activity with the shell 106 and core 104 material is readily determined by one of skill in the art, having the benefit of the disclosures herein, for specified shell 106 and core 104 materials with a known agitation profile through simple empirical testing.

The system 200 further includes a high pressure water wash 216 operable to wash the cast component 102 within the submersion vessel 206. The high pressure water wash 216 may comprise the same or similar equipment to the water jet 202, for example the water jet 202 may have a configurable nozzle with a more focused stream for the water jet 202 and a more diffuse stream for the high pressure water wash 216. The high pressure water wash 216 may operate with the cast component 102 immersed in the leaching solution 220 to enhance removal of the VPC shell 106 and core 104.

The submersion vessel 206 may be further adapted to accept a heat input 212 and/or a pressure reduction—for example through a volume modulating unit 214—to produce a high agitation leaching solution 222 in the submersion vessel 206. The high agitation leaching solution 222 may comprise any leaching material known in the art. In one embodiment, the high agitation leaching solution 222 comprises a caustic solution that experiences intermittent boiling produced from the heat input 212 and/or through pressure reduction by the volume modulating unit 214. The heat input 212 may be any device or combination of devices known in the art to transfer heat to the high agitation leaching solution 222, including without limitation a heater, a burner, and a heat exchanger. The boiling of the caustic solution may increase the agitation and mass transfer of ceramic away from the shell 106 and core 104. For example, an apparatus such as that described in U.S. Pat. No. 6,739,380 to Schlienger et al., incorporated herein by reference, may be utilized to produce the high agitation leaching solution 222. The high agitation leaching solution 222 may comprise a pre-agitation solution within a storage tank, and become the high agitation leaching solution 222 upon entry to the submersion vessel 206 and subsequent intermittent boiling.

The high agitation leaching solution 222 may be a caustic solution with a high concentration KOH, for example a KOH solution with a concentration of about 82.3% KOH. The caustic solution provided for the high agitation leaching solution 222 may be provided by a second caustic tank 218 and may be the same or a separate caustic solution from the caustic tank 208 providing solution for the leaching solution 220. The high pressure water wash 216 may operate with the cast component 102 immersed in the high agitation leaching solution to enhance removal of the VPC shell 106 and core 104, resulting in reduced removal times of the remaining bulk shell 106 and core 104 materials.

The system 200 further includes a high pressure water wash 216 operable to wash the cast component 102 within the submersion vessel 206. The high pressure water wash 216 may be operable while the high agitation caustic solution 222 is present in the submersion vessel 206. The cast component 102 may be exposed to the high agitation leaching solution 222 and the high pressure water wash 216 for a minimal time. Non-limiting examples of a minimal time include a time known or estimated to be the lowest amount of time to achieve removal of the bulk of the VPC shell 106 and core 104 material, and/or to expose a large fraction of the cast component 102 surface. For example, a time that removes a selected fraction (e.g. 50%) of the remaining VPC shell 106 and core 104 material may be a minimal time. In another example, a time that removes VPC shell 106 and core 104 material but that does not cause any observable degradation in the cast component 102 coating may be used as a maximum value for the minimal time. The time required to remove a selected fraction of the VPC shell 106 and core 104 material, and/or the time at which any observable degradation occurs on the cast component 102 coating depend upon specific factors such as the KOH concentration, the amount of agitation and the pressure of the high pressure water wash 216, and the time required is readily determined for a specific embodiment according to simple empirical testing by one of skill in the art having the benefit of the disclosures herein.

The system 200 further includes an electroless nickel-boron coating solution 224 and a quantity of an electrolytic palladium coating solution 226. The cast component 102 may be immersed in the electroless nickel-boron coating solution 224 to place a nickel-boron coating on exposed surfaces of the cast component 102. The cast component 102 may then be immersed in the electrolytic palladium coating solution 226 to place a palladium coating on exposed surfaces of the cast component 102. The system 200 may further include electrical sources, valves and drains for switching fluids within the submersion vessel 206, and other components useful in draining the leaching solutions 220, 222 and placing the nickel-boron and palladium coatings. These system aspects for coating a cast component 102 are well understood in the art and not shown in FIG. 2 to avoid obscuring aspects of the present application.

The system 200 further includes a second high agitation leaching solution 228, which may be the same or a different solution as the high agitation leaching solution 222, and may be supplied by a third caustic tank 230. The submersion vessel 206 is further adapted to contain the cast component 102 and the second high agitation leaching solution 228. In one embodiment, the submersion vessel 206 holds the cast component 102 in the second high agitation leaching solution 228 for an extended period—for example approximately three days.

In one embodiment, the system 200 further includes a peening instrument 232, for example a pneumatic bead gun—adapted to glass bead peen the cast component 102. The peening instrument 232 may utilize glass, ceramic, steel, aluminum, or any other peening material known in the art. The peening instrument 232 may peen the cast component 102 sufficiently to reduce porosity of the palladium coating and/or the nickel-boron coating on the cast component 102. The peening instrument 232 operates before the cast component 102 is submerged in the second high agitation leaching solution 228.

Figure 3A:
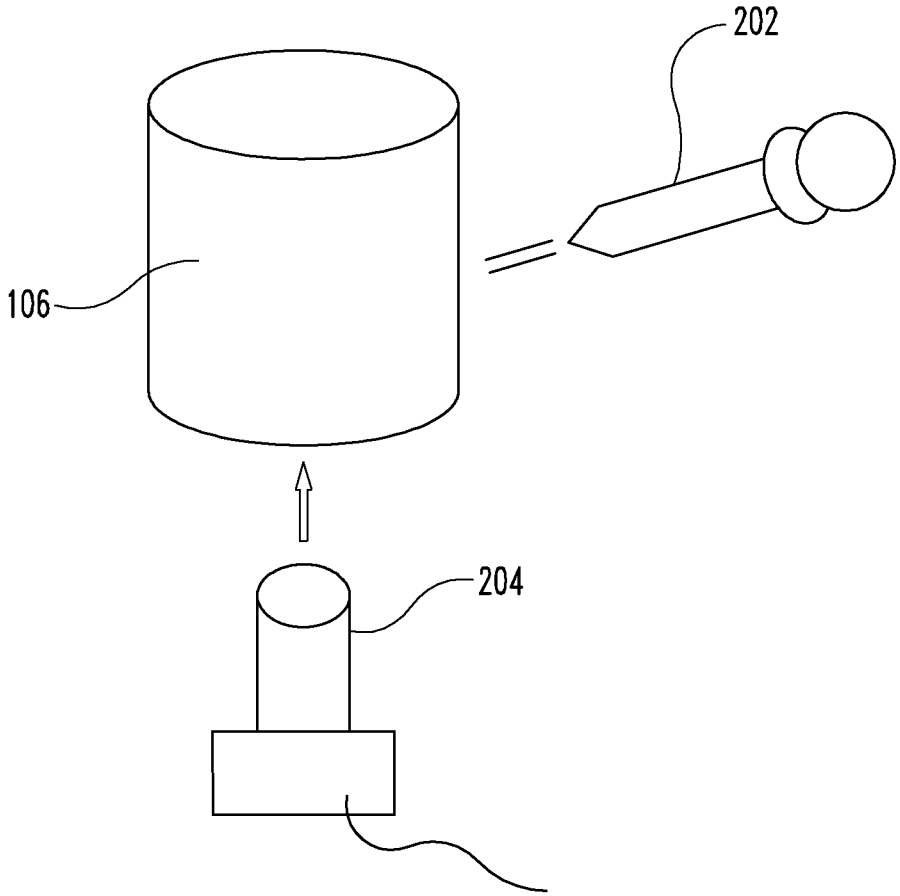
FIG. 3A schematically illustrates an alternate embodiment of a system for leaching castings in a first state.

FIG. 3A schematically illustrates an alternate embodiment of a system for leaching castings in a first state. The embodiment illustrated in FIG. 3A is consistent with the system 200 wherein the water jet 202 and laser drill 204 are utilized to remove at least a portion of a VPC shell 106 from a cast component 102. The illustration of FIG. 3A shows a water jet 202 and laser drill 204, but any focused removal technique understood in the art may be utilized for removing portions of the VPC shell 106. Removal of portions of the VPC shell 106 may further include opening up portions of the core 104 for improved contact with a leaching solution 220, 222, 228.

Figure 3B:
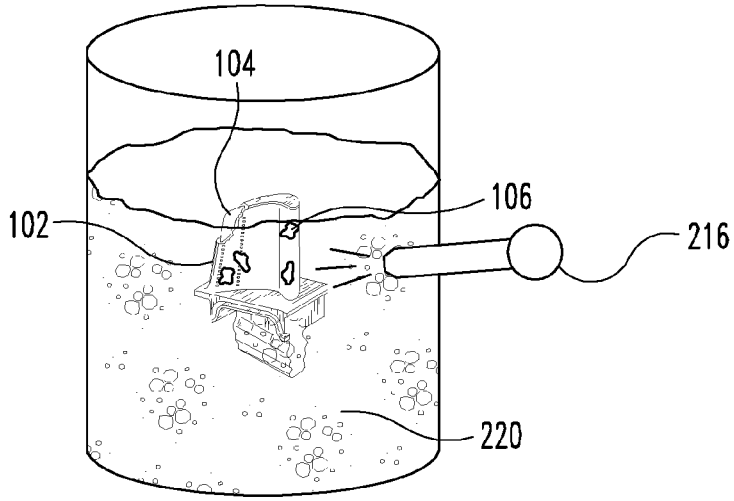
FIG. 3B schematically illustrates an alternate embodiment of a system for leaching castings in a second state.

FIG. 3B schematically illustrates an alternate embodiment of a system for leaching castings in a second state. The embodiment illustrated in FIG. 3B is consistent with the system 200 wherein the submersion vessel 206 is at least partially filled with leaching solution 220. The casting component 102 is illustrated within the submersion vessel 206, and a high pressure water wash 216 is working with the leaching solution 220 to remove an internal core 104 material from the cast component 102, and further to remove at least a portion of the VPC shell 106 remainder.

Figure 3C:
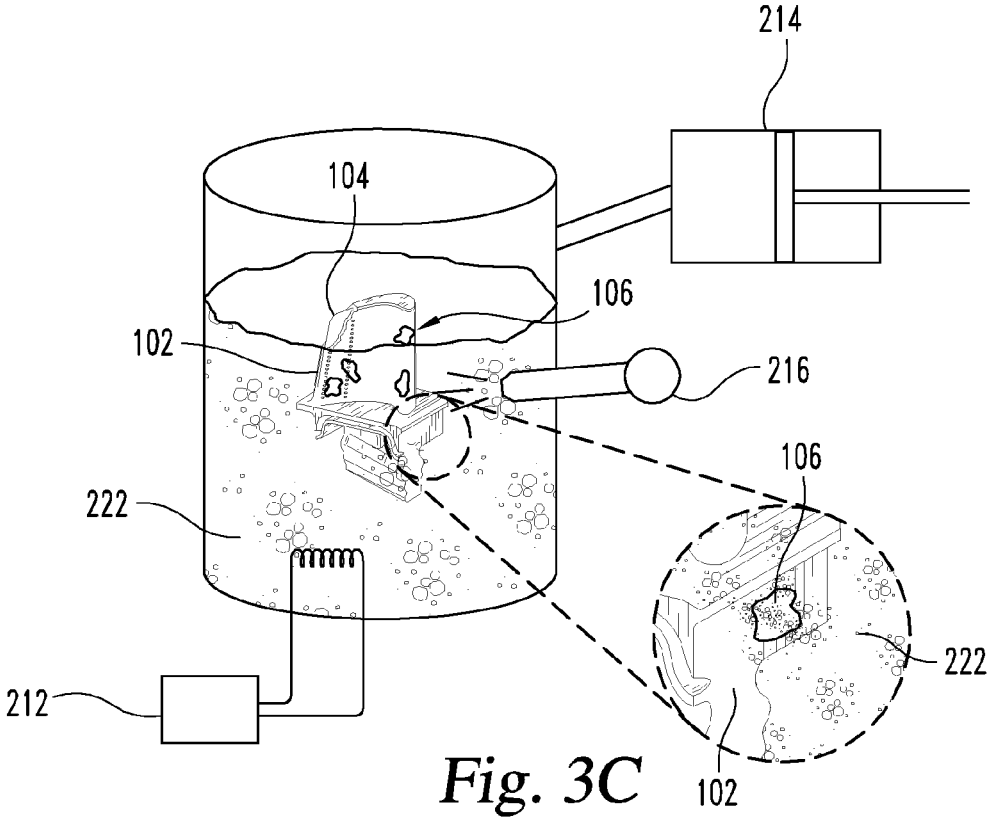
FIG. 3C schematically illustrates an alternate embodiment of a system for leaching castings in a third state FIG. 3D schematically illustrates an alternate embodiment of a system for leaching castings in a fourth state.

FIG. 3C schematically illustrates an alternate embodiment of a system for leaching castings in a third state. The embodiment illustrated in FIG. 3C is consistent with the system 200 wherein the submersion vessel 206 is at least partially filled with a first high agitation leaching solution 222. The first high agitation leaching solution 222 may be a leaching solution 222 subject to intermittent boiling caused by a heat input 212 heating the first high agitation leaching solution 222 and/or a volume modulating unit 214 reducing the pressure in the submersion vessel 206 such that the first high agitation leaching solution 222 boils. In the embodiment of FIG. 3C, the high pressure water wash 216, which may be a second high pressure water wash 216, is also being utilized to enhance removal of the core 104 and shell 106. The first high agitation leaching solution 222 and high pressure water wash 216 may be utilized together for a minimal time. The first high agitation leaching solution 222 may be a high concentration KOH solution. FIG. 3C includes an illustrated close-up showing nucleation sites of the boiling first high agitation leaching solution 222 attacking a remainder of the shell 106.

Figure 3D:
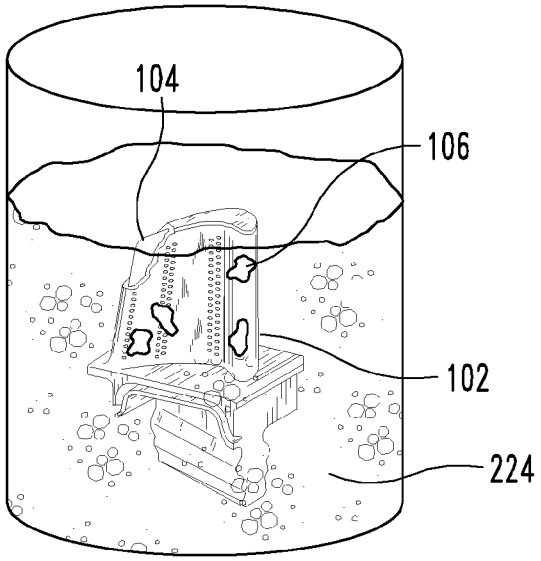
FIG. 3E schematically illustrates an alternate embodiment of a system for leaching castings in a fifth state.
FIG. 3F schematically illustrates an alternate embodiment of a system for leaching castings in a sixth state.
FIG. 3G schematically illustrates an alternate embodiment of a system for leaching castings in a seventh state.

FIG. 3D schematically illustrates an alternate embodiment of a system for leaching castings in a fourth state. The embodiment illustrated in FIG. 3D is consistent with the system 200 wherein the submersion vessel 206 is at least partially filled with an electroless nickel-boron coating solution 224 to apply an electroless nickel-boron coating to the cast component 102. The electroless nickel-boron coating may be applied to a thickness of between about 0.0002 and 0.0003 inches. The thickness of the electroless nickel-boron coating may vary within any economic limits—for example where an aggressive caustic treatment is required including a long exposure time and/or a high concentration solution, a thicker coating may be applied. Where the caustic treatment is less aggressive a thinner and therefore less expensive nickel-boron coating may be applied.

Figure 3E:
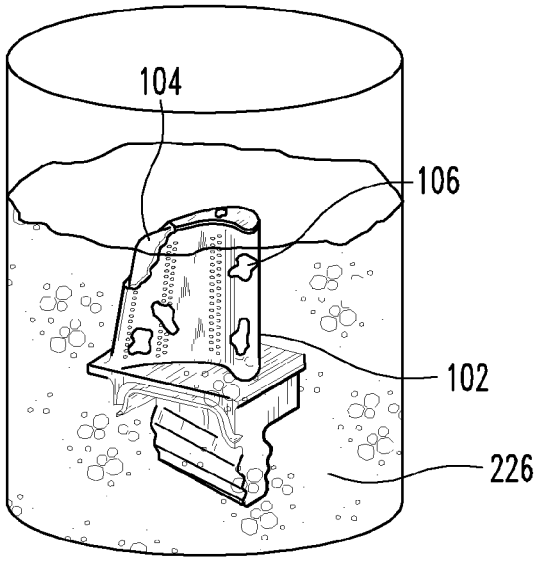

FIG. 3E schematically illustrates an alternate embodiment of a system for leaching castings in a fifth state. The embodiment illustrated in FIG. 3E is consistent with the system 200 wherein the submersion vessel 206 is at least partially filled with an electrolytic palladium solution 226 to apply an electrolytic palladium coating to the cast component 102. The electrolytic palladium coating may be applied to a thickness of between about 0.0002 and 0.0003 inches. The thickness of the electrolytic palladium coating may vary within any economic limits—for example where an aggressive caustic treatment is required including a long exposure time and/or a high concentration solution, a thicker coating may be applied. Where the caustic treatment is less aggressive a thinner and therefore less expensive electrolytic palladium coating may be applied.

Figure 3F:
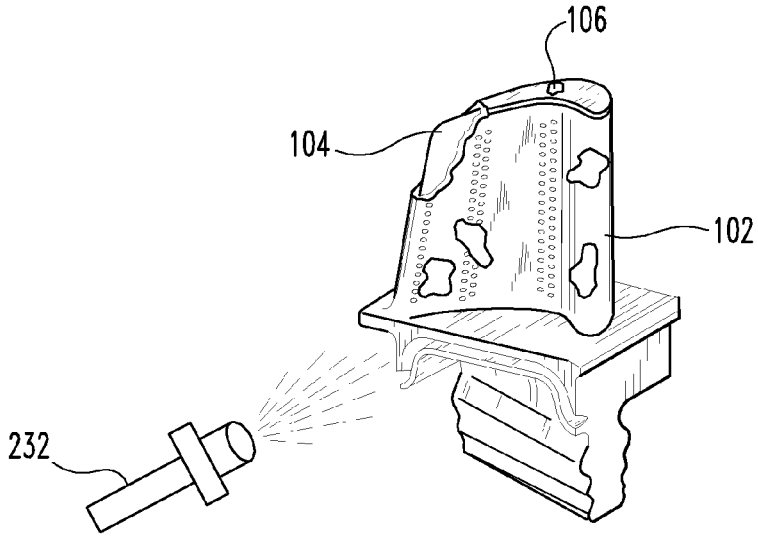

FIG. 3F schematically illustrates an alternate embodiment of a system for leaching castings in a sixth state. The embodiment illustrated in FIG. 3F is consistent with a peening instrument 232 peening the cast component 102 with glass beads to reduce any porosity within the electrolytic palladium coating and/or the electroless nickel-boron coating.

Figure 3G:
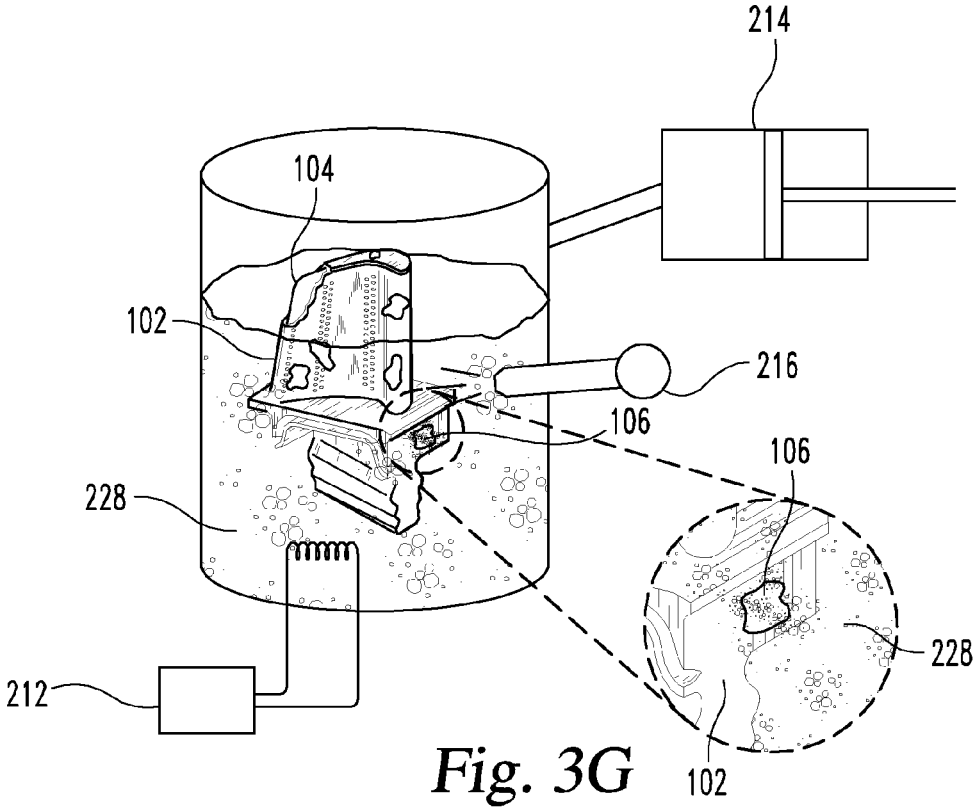

FIG. 3G schematically illustrates an alternate embodiment of a system for leaching castings in a seventh state. The embodiment illustrated in FIG. 3G is consistent with the system 200 wherein the submersion vessel 206 is at least partially filled with a second high agitation leaching solution 228. The casting component 102 is exposed to the second high agitation leaching solution 228 to remove the shell 106 remainder and the core 104 remainder. The second high agitation leaching solution 228 may be a high concentration KOH solution, and may be the same or a different solution as the first high agitation leaching solution 222. The casting component 102 may remain in the second high agitation leaching solution 228 for an extended period, for example approximately three days. The second high agitation leaching solution 228 may be a leaching solution 228 subject to intermittent boiling caused by a heat input 212 heating the first high agitation leaching solution 222 and/or a volume modulating unit 214 reducing the pressure in the submersion vessel 206 such that the second high agitation leaching solution 228 boils. FIG. 3G includes an illustrated close-up showing nucleation sites of the boiling second high agitation leaching solution 228 attacking a remainder of the shell 106.

As is evident from the figures and text presented above, a variety of embodiments of the present application are contemplated. One non-limiting embodiment of the present invention includes utilizing a focused removal technique to remove at least a portion of a virtual pattern case (VPC) shell from a cast component. The embodiment further includes exposing the cast component to a leaching solution and a high pressure water wash to remove an internal core material from the cast component and to remove at least a portion of the VPC shell remainder. The embodiment further includes exposing the cast component to a first high agitation leaching solution comprising a leaching solution subject to intermittent boiling. The intermittent boiling occurs through a temperature increase and/or a pressure decrease in a submersion vessel enclosing the first high agitation leaching solution.

A further embodiment includes applying an electroless nickel-boron coating to the cast component, and applying an electrolytic palladium coating to the cast component. An embodiment further includes exposing the cast component to a second high agitation leaching solution to remove the VPC shell remainder and an internal core material remainder.

Still another embodiment of the invention includes the focused removal technique comprising a water jet and/or a laser drill. Another embodiment includes the electroless nickel-boron coating comprising a thickness of between about 0.0002-0.0003 inches, and in one embodiment the electrolytic palladium coating comprises a thickness of between about 0.0002 and 0.0003 inches. In a further contemplated embodiment, a peening instrument peens the cast component with glass beads to reduce porosity in the nickel-boron and/or palladium coatings.

A further embodiment of the invention includes exposing the cast component to a second high agitation leaching solution for approximately three days. In a further embodiment, the cast component is a superalloy gas turbine engine blade, and the VPC shell and internal core material are ceramic. In a still further embodiment, the first and second high agitation leaching solutions include a high concentration KOH, and the leaching solution includes a low concentration KOH. In a still further embodiment, the cast component is exposed to the high pressure wash with the first high agitation leaching solution, and the exposure to the first high agitation leaching solution is for a minimal time.

An additional embodiment of the present invention includes a system having a water jet and/or laser drill adapted to remove at least a portion of a VPC shell from a cast component. A further embodiment includes a submersion vessel adapted to contain the cast component and a quantity of a leaching solution, and a high pressure wash operable to wash the cast component within the submersion vessel. In a further embodiment, the submersion vessel is adapted to accept a heat input and/or a pressure reduction to produce a first high agitation leaching solution. In a still further embodiment, the submersion vessel is further adapted to contain a quantity of an electroless nickel-boron coating solution and a quantity of an electrolytic palladium coating solution. The submersion vessel is further adapted, in one embodiment, to contain the cast component and a second high agitation leaching solution for a period of approximately three days.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred, more preferred or exemplary utilized in the description above indicate that the feature so described may be more desirable or characteristic, nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A method, comprising:

utilizing a focused removal technique to remove at least a portion of a virtual pattern cast (VPC) shell from a cast component;

exposing the cast component to a leaching solution and a first high pressure water wash to remove an internal core material from the cast component and to remove at least a portion of a VPC shell remainder;

operating the first high pressure water wash with the cast component exposed to the leaching solution;

exposing the cast component to a first high agitation leaching solution, the first high agitation leaching solution comprising a leaching solution subject to intermittent boiling caused by at least one of heating the first high agitation leaching solution and reducing a pressure in a submersion vessel;

applying an electroless nickel-boron coating to the cast component;

applying an electrolytic palladium coating to the cast component; and exposing the cast component to a second high agitation leaching solution to remove an internal core material remainder, wherein the step of exposing the cast component to the second high agitation leaching solution follows the steps of applying an electroless nickel-boron coating and applying an electrolytic palladium coating.

2. The method of claim 1, wherein the focused removal technique comprises at least one of a water jet and a laser drill.

3. The method of claim 1, wherein the electroless nickel-boron coating comprises a thickness of between about 0.0002 and 0.0003 inches.

4. The method of claim 1, wherein the electrolytic palladium coating comprises a thickness of between about 0.0002 and 0.0003 inches.

5. The method of claim 1, peening the cast component with glass beads before exposing the cast component to the second high agitation leaching solution.

6. The method of claim 1, wherein exposing the cast component to the second high agitation leaching solution comprises exposing the cast component to the high agitation leaching solution for approximately three days.

7. The method of claim 1, wherein the cast component comprises a superalloy, and wherein the VPC shell and internal core material comprise a ceramic.

8. The method of claim 1, wherein the cast component comprises a casting of a gas turbine engine blade.

9. The method of claim 1, further comprising exposing the cast component to a second high pressure water wash while exposing the cast component to the first high agitation leaching solution.

10. The method of claim 9, further comprising exposing the cast component to the first high agitation leaching solution for a time over which 50% of the remaining casting shell and a core material is removed.

11. The method of claim 1, wherein the leaching solution comprises a low concentration KOH solution.

12. The method of claim 11, wherein the low concentration KOH solution comprises a solution of less than 65% KOH by weight.

13. A method, comprising:

utilizing least one of a water jet removal and a laser drilling removal to remove at least a portion of a virtual pattern cast (VPC) shell from a cast component;

exposing the cast component to a KOH bath and a high pressure water wash to remove an internal core material from the cast component and at least a portion of a VPC shell remainder;

operating the first high pressure water wash with the cast component exposed to the KOH solution;

exposing the cast component to a high agitation KOH solution and the high pressure water wash, the high agitation KOH solution comprising a KOH solution subject to intermittent boiling caused by at least one of heating the KOH solution and reducing a pressure in a submersion vessel;

applying an electroless nickel-boron coating to the cast component;

applying an electrolytic palladium coating to the cast component; and exposing the cast component to the high agitation KOH solution to remove an internal core material remainder, wherein the step of exposing the cast component to the high agitation KOH solution follows the steps of applying an electroless nickel-boron coating and applying an electrolytic palladium coating.

14. The method of claim 13, further comprising peening the cast component with glass beads.

15. The method of claim 14, wherein the cast component comprises a superalloy, and wherein the VPC shell and internal core material comprise a ceramic.

16. The method of claim 15, wherein the cast component comprises a casting of a gas turbine engine blade.

17. The method of claim 16, wherein the electroless nickel-boron coating comprises a thickness of between about 0.0002 and 0.0003 inches.

18. The method of claim 17, wherein the electrolytic palladium coating comprises a thickness of between about 0.0002 and 0.0003 inches.

* * * * *